US011814778B2

(12) United States Patent
Kehl

(10) Patent No.: US 11,814,778 B2
(45) Date of Patent: Nov. 14, 2023

(54) VENTING LATCH ASSEMBLY FOR FRONT-LOADING WASHING MACHINE

(71) Applicant: WHIRLPOOL CORPORATION, Benton Harbor, MI (US)

(72) Inventor: Dennis Kehl, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 225 days.

(21) Appl. No.: 17/410,341

(22) Filed: Aug. 24, 2021

(65) Prior Publication Data

US 2023/0062358 A1 Mar. 2, 2023

(51) Int. Cl.

| | |
|---|---|
| ***D06F 39/14*** | (2006.01) |
| ***E05B 63/24*** | (2006.01) |
| ***E05B 47/00*** | (2006.01) |

(52) U.S. Cl.

CPC ..... *D06F 39/14* (2013.01); *E05B 47/0046* (2013.01); *E05B 63/248* (2013.01)

(58) Field of Classification Search

CPC ..... D06F 39/14; E05B 47/0046; E05B 63/248
USPC ..... 68/3 R
See application file for complete search history.

(56) References Cited

U.S. PATENT DOCUMENTS

| | | | | |
|---|---|---|---|---|
| 8,959,960 | B2 | 2/2015 | Hill et al. | |
| 2011/0062838 | A1* | 3/2011 | Kim | D06F 39/14 312/228 |
| 2012/0032569 | A1* | 2/2012 | Hill | D06F 39/14 312/228 |
| 2021/0047770 | A1 | 2/2021 | Attar et al. | |

FOREIGN PATENT DOCUMENTS

| | | | |
|---|---|---|---|
| EP | 2258897 | A1 | 12/2010 |
| EP | 3757276 | A1 | 12/2020 |

* cited by examiner

*Primary Examiner* — Tinsae B Ayalew
(74) *Attorney, Agent, or Firm* — Brooks Kushman P.C.

(57) ABSTRACT

A front-loading washing machine includes a door frame, a latch, a door, a seal, and a striker. The latch is secured to the door frame. The door is rotatably secured to the door frame. The seal is disposed between the door and the door frame. The striker is secured to the door. The striker is configured to disengage the latch in a first configuration while the door is in a closed position such that a gap is formed between the door and the door frame to facilitate venting from an interior of the washing machine. The striker is configured to engage the latch in a second configuration while the door is in the closed position such that the seal closes the gap between the door and the door frame to inhibit venting from the interior of the washing machine.

20 Claims, 5 Drawing Sheets

VENTING LATCH ASSEMBLY FOR FRONT-LOADING WASHING MACHINE

TECHNICAL FIELD

The present disclosure relates to washing or laundry machines.

BACKGROUND

Washing machines are configured to clean clothes and other garments. Washing machines may be top-loading or front-loading type washing machines.

SUMMARY

A front-loading washing machine includes a door frame, a latch, a door, a striker, a seal and a biasing element. The latch is secured to the door frame. The door is secured to the door frame and is configured to transition between open and closed positions. The striker is secured to the door and is configured to engage the latch to lock the door in the closed position. The seal is disposed on the door frame and is configured to engage the door to prevent fluid transport between the door and the door frame when the door is in the closed position and the striker is engaging the latch. The biasing element is secured to the door or the door frame and is configured to bias the door away from the door frame when the door is in the closed position and the striker is disengaged from the latch such that a gap is formed between the seal and the door to facilitate venting between the door and the door frame.

A front-loading washing machine includes a door frame, a latch, a door, a seal, and a striker. The latch is secured to the door frame. The door is secured to the door frame and is configured to transition between open and closed positions. The seal is disposed between the door and the door frame. The seal is configured to prevent fluid transport between the door and the door frame. The striker is secured to the door. The striker is configured to disengage the latch in a first position while the door is in the closed position such that a gap is formed between the seal and the door to facilitate venting between an interior and an exterior of the washing machine. The striker is configured to engage the latch in a second position while the door is in the closed position such that the seal engages the door to inhibit venting between the interior and the exterior of the washing machine.

A front-loading washing machine includes a door frame, a latch, a door, a seal, and a striker. The latch is secured to the door frame. The door is rotatably secured to the door frame. The seal is disposed between door and the door frame. The striker is secured to the door. The striker is configured to disengage the latch in a first configuration while the door is in a closed position such that a gap is formed between the door and the door frame to facilitate venting from an interior of the washing machine. The striker is configured to engage the latch in a second configuration while the door is in the closed position such that the seal closes the gap between the door and the door frame to inhibit venting from the interior of the washing machine.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
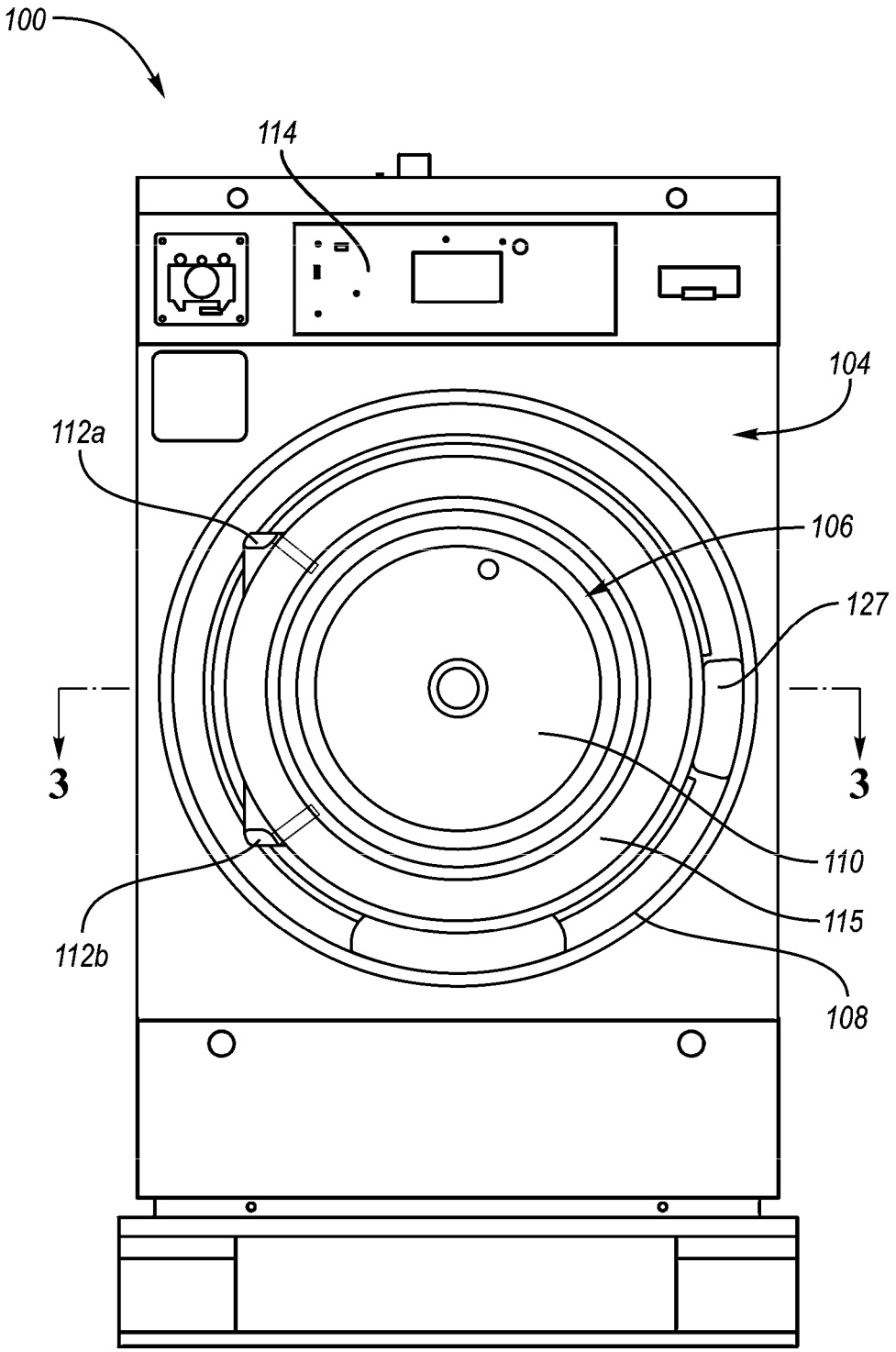
FIG. 1 illustrates a front elevational view of an appliance having a door in a closed position.
Figure 2:
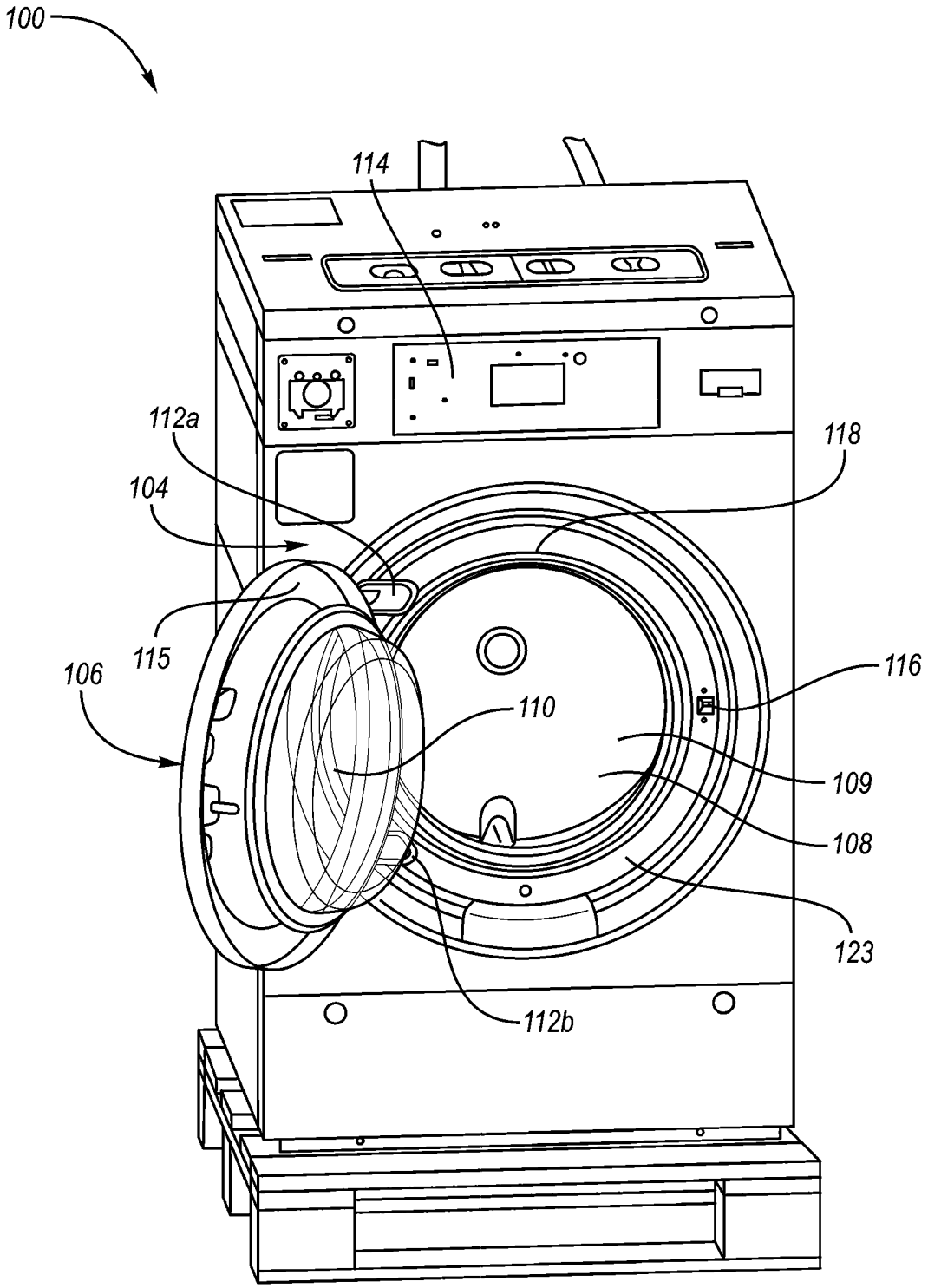
FIG. 2 illustrates a front perspective view of the appliance with the door in an open position.

FIG. 1 illustrates a front elevational view of a commercial appliance 100 having a door 106 in a closed position. FIG. 2 illustrates a front perspective view of the appliance 100 with the door 106 in an open position. The commercial appliance 100 may be a laundry appliance 100 such as a washing machine or dryer, configured to treat laundry, such as by washing and/or drying clothes and other textiles and items. The laundry appliance 100 may more specifically be a front-loading washing machine or dryer. While the appliance 100 may be referred to as a laundry appliance throughout, the appliance 100 may include other appliances such as dishwashers, ice makers, freezers, refrigerators, among others, that include doors or other closable openings.

The appliance 100 may include a cabinet having a front panel 104. The cabinet may house components typically found in a laundry appliance such as a laundry drum 109 (visible in FIG. 2) configured to receive laundry items, as well as a chassis, frame, motors, controls, fluid lines, sensors, vents, etc. The laundry drum 109 may be configured to receive laundry and rotate about an axis. In this example, the axis may be relatively horizontal. An access opening 108 may be defined in the front panel 104 to allow access to the drum 109. The access opening 108 may be selectively accessible via the door 106. The front panel 104 may be referred to as a door frame. The door 106 is secured to the front panel 104 and is configured to transition between an open position (e.g., FIG. 2) and a closed position (e.g., FIG. 1).

The door 106 may be rotatably attached to the front panel 104 about the access opening 108 via at least one hinge assembly 112. The hinge assembly 112 may include a pair of hinge assemblies 112, as shown in the example of FIGS. 1 and 2 as a first hinge assembly 112*a* and a second hinge assembly 112*b* and collectively referred to as hinge assembly or hinge assemblies 112. The hinge assemblies 112 may be spaced apart from one another along a vertical axis. In the example of a round or circular door, the hinge assemblies 112 may be placed at approximately 8 o'clock and 10 o'clock positions. In an example where the door is hinged on the opposite side, the hinge assemblies 112 may be placed at approximately 2 o'clock and 4 o'clock positions. More or fewer hinge assemblies 112 may be included. It is also conceivable that a hinge assembly 112 is arranged at the top or the bottom of the door 106.

The door 106 may rotate or hinge about the hinge assembly 112 between the open and closed positions. A latch 116 may be secured to the front panel 104 and may be arranged at or near the access opening 108 to latch or lock the door 106 in the closed position. The latch 116 may be arranged on an opposite side of the opening 108 relive to the hinge assembly 112. The hinge assembly 112 may be capable of disengaging the door 106 from the latch 116 in order to open the door 106, as well as engaging the latch 116 with the door 106 upon closing the door 116.

The door 106 may define a window 110 or a clear substrate to allow users to see inside the drum 109. The window 110 may be a bowl-like shape, or semi-circular shape, or the window 110 may be flat. Depending on the type of appliance 100, the window 110 may be formed of plastic, or in the example of the appliance being a dryer, the window may be glass. The door 106 includes a frame 115 surrounding the window 110. The door 106 may include various seals and gaskets, as well as other structural portions such as collars, flanges, plates, harnesses, screws, etc.

The front panel 104 may include a recessed region 123 that surrounds the access opening 108. A gasket or seal 118 (e.g., a rubber or soft plastic seal) may be arranged around the inside of the recessed area 123 of the front panel 104 to create a hermetical seal against the door 106 when the door 106 is in a closed position. Stated in other terms, the seal 118 is configured to engage the door 106 to prevent fluid flow or transport between the door 106 and the front panel 104 proximate the recessed area 123 when the door is in the closed position. Alternatively, the seal 118 could be secured to the door 106 and could be configured to engage the front panel 104 to prevent fluid flow transport between the door 106 and the front panel 104. In any configuration, the seal 118 is disposed between the door 106 and the front panel 104. The hinge assembly 112 may be attached to front panel 104 along the recessed region 123 or partially along the recess region 123. The recessed region 123 may more specifically form the door frame as opposed to the front panel 104 as a whole.

The appliance 100 may further include a controller coupled with various working components of the appliance 100 to control the operation of the working components and to implement one or more treating cycles of operation. The control system can further include a user interface 114 that is operably coupled with the controller. The user interface 114 can include one or more knobs, dials, switches, displays, touch screens and the like for communicating with the user, such as to receive input and provide output. The user can enter different types of information including, without limitation, cycle selection and cycle parameters, such as cycle options.

The controller can include the machine controller and any additional controllers provided for controlling any of the components of the appliance 100. For example, the controller can include the machine controller and a motor controller for operating a motor that rotates the drum 109. Many known types of controllers can be used for the controller. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the appliance 100.

The controller can be provided with a memory and a central processing unit (CPU). The memory can be used for storing the control software that can be executed by the CPU in completing a cycle of operation using the appliance 100 and any additional software. Examples, without limitation, of treating cycles of operation include: wash, heavy-duty wash, delicate wash, quick wash, pre-wash, refresh, rinse only, and timed wash, which can be selected at the user interface 114. The memory can also be used to store information, such as a database or table, and to store data received from the one or more components of the appliance 100 that can be communicably coupled with the controller. The database or table can be used to store the various operating parameters for the one or more cycles of operation, including factory default values for the operating parameters and any adjustments to them by the control system or by user input.

The controller may comprise a single controller or may be part of a larger control system and may control or be controlled by various other controllers throughout the appliance 100. It should therefore be understood that the controller and one or more other controllers can collectively be referred to as a "controller" that controls various subcomponents or actuators of the appliance 100 in response to signals from various subcomponents or sensors of the appliance 100 to control various functions. The controller may include the microprocessor or central processing unit (CPU), which may be in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the appliance 100.

Figure 3:
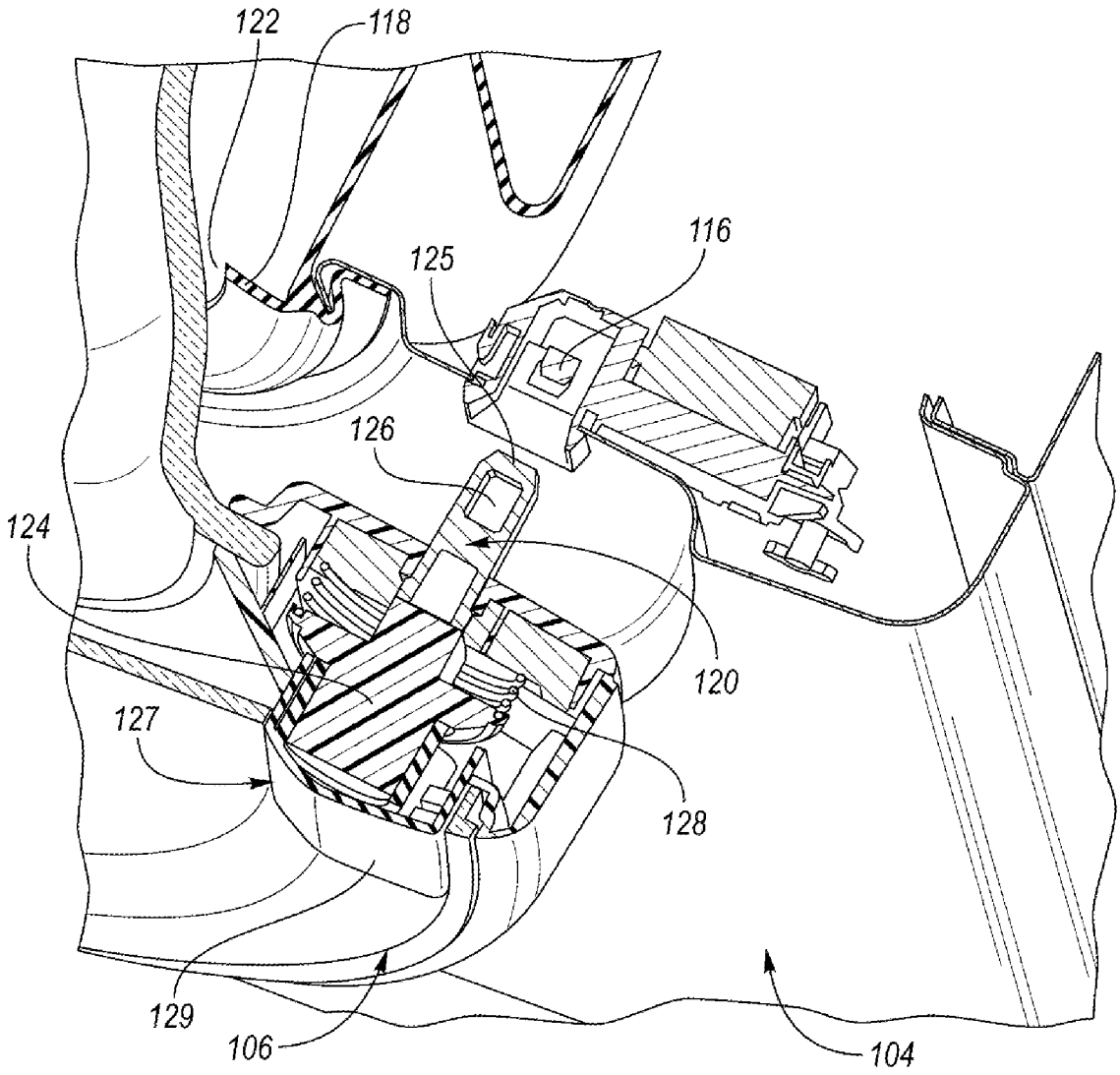
FIG. 3 is a cross-sectional view of the appliance taken along line 3-3 in FIG. 1 with the door in a closed and unlocked position.
Figure 4:
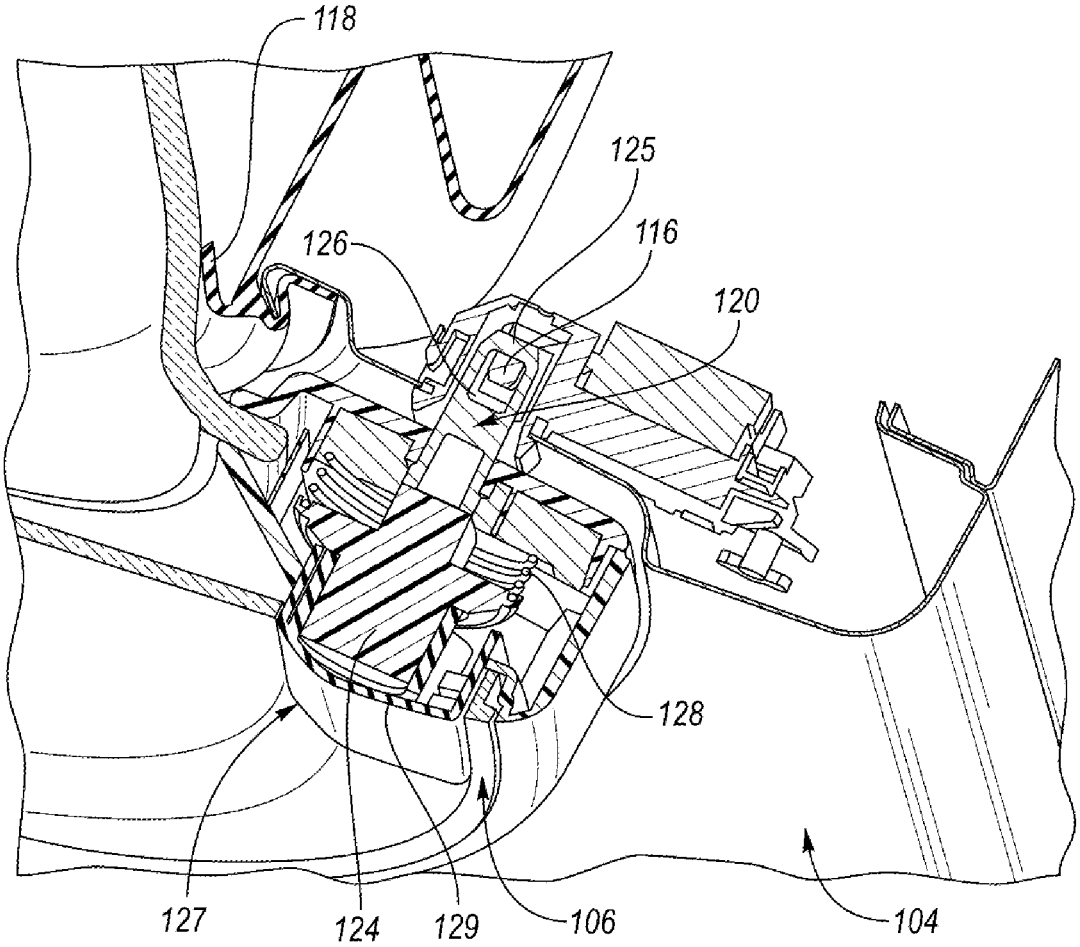
FIG. 4 is a cross-sectional view of the appliance taken along line 3-3 in FIG. 1 with the door in a closed and locked position.

Referring now to FIGS. 3 and 4, cross-sectional views of the appliance 100 are illustrated with the door 106 in a closed and unlocked position and with the door 106 in a closed and locked position, respectively. A spike or striker 120 that is configured to engage the latch 116 is secured to the door 106 and extends inward from an interior side of the door 106 and toward the front panel 104.

In a first position or configuration, the striker 120 is disengaged from the latch 116 while the door 106 is in a closed position (see FIG. 3). When the striker 120 is disengaged from the latch 116 such that the door 106 is in the closed and unlocked position, a gap 122 is formed between the door 106 and the front panel 104 to facilitate venting between an interior and an exterior of the appliance 100. More specifically, the gap 122 may be formed between the door 106 and the seal 118. Such venting may be desirable between cycles of operation of the appliance 100 to allow moisture within the appliance 100 to evaporate and to prevent a buildup of mildew or mold within the appliance 100. A front end 125 of the striker 120 may be spaced apart from the latch 116 as illustrated or may abut an outer surface of the latch 116 in the closed and unlocked position.

In a second position or configuration (see FIG. 4), the striker 120 is configured to engage the latch 116 to latch or lock the door 106 in the closed position. When the striker 120 engages the latch 116 such that the door 106 is in the closed and locked position, the seal 118 engages the door 106 to prevent fluid flow or transport between the door 106 and the front panel 104. Stated in other terms, the engagement between the striker 120 and the latch 116 places the door closer to the front panel 104 such that the seal 118 closes the gap 122 and engages the door 106 to inhibit venting between the interior and the exterior of the appliance 100, which is desirable during a wash or rinse cycle when water and/or detergent is channeled into the drum 109 to clean clothes or other textiles.

The appliance 100 may further include a push button 124 and the striker 120 may be secured to the push button 124. The push button 124 may be disposed within a handle portion 127 of the door 106. A flexible membrane or boot 129 made from a soft material, such as rubber or soft plastic, may be disposed over the push button 124 along an exterior side of the door 106. The boot 129 is flexible so that an operator may engage or push the push button 124 through the boot 129. Advancing or pushing the push button 124 toward the latch 116 when the door is in the closed and unlocked position (i.e., the position where the door 106 is closed and the striker 120 is disengaged from the latch 116) advances the striker 120 such that the striker 120 engages the latch 116 and such that the engagement between the striker 120 and the latch 116 locks the door 106 in the closed position. More specifically, during engagement between the striker 120 and the latch 116, the front end 125 of the striker 120 may apply a force to the latch 116 in a lateral direction that is substantially perpendicular to the direction of movement of the striker 120 such that the latch 116 moves laterally outward relative to the striker 120 so that strikers is allowed to move forward. Substantially perpendicular may refer to any incremental angle that is between exactly perpendicular and 15° from exactly perpendicular.

A biasing element 128, such as a spring, may be disposed between the push button 124 and an internal surface of the door 106. The biasing element 128 is configured to biasing the push button 124 away from the latch 116. The biasing element 128 is also configured to bias the striker 120 away from the latch 116 and toward disengagement from the latch (e.g., FIG. 3). More specifically, the biasing element is configured to bias the striker 120 away from the latch 116 while the door 106 is in the closed position such that engagement of the push button 124 (i.e., advancing or pushing the push button 124 toward the latch 116) is required in order for the striker 120 to engage the latch 116 in order to lock the door 106 in the closed position once the door 106 has been transitioned to the closed position.

Once the striker 120 has moved sufficiently forward, the latch 116 may spring back such that the striker extends into or through an orifice 126 defined by the striker 120 to secure the position of the striker 120 relative to the latch 116 and lock the door 106 in the closed position. The latch 116 may include a ramped surface that facilitates lateral movement of the latch 116 upon engagement between the front end 125 of the striker 120 and the ramped surface of the latch 116 when the striker 120 is moved forward. A biasing element, such as a spring, may be configured to force the latch 116 into the orifice 126 once striker 120 has moved sufficiently forward to secure the position of the striker 120 relative to the latch 116 and lock the door 106 in the closed position. Alternatively, the latch 116 may be connected to a device, such as an electric solenoid, that facilitates lateral movement of the latch during engagement with the striker 120. Such an electric solenoid may be in communication with and controlled by the controller and may be configured to secure the position of the latch 116 during operation of the appliance 100. For example, the solenoid may lock the latch 116 such that the striker 120 cannot be pulled out of the latch 116 once a wash cycle has started in order to prevent someone from opening the door 106 during a wash cycle.

Figure 6:
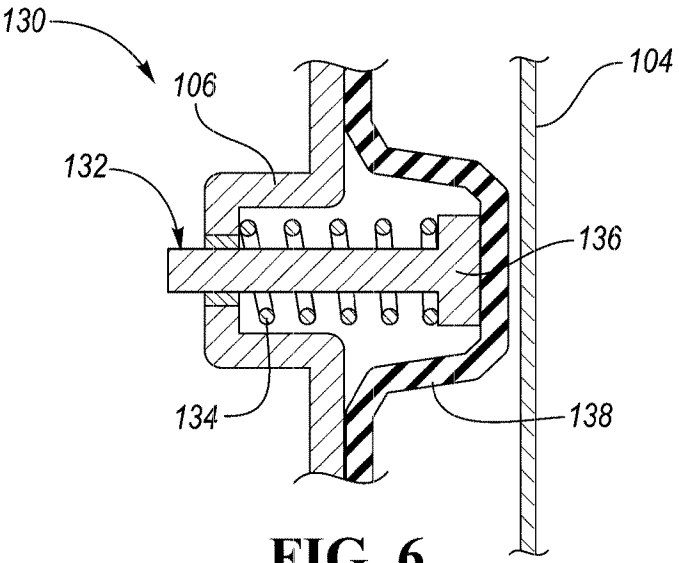
FIG. 6 is a cross-sectional view taken along line 6-6 in FIG. 5 illustrating a plunger mechanism when the door is in the closed and unlocked position.
Figure 7:
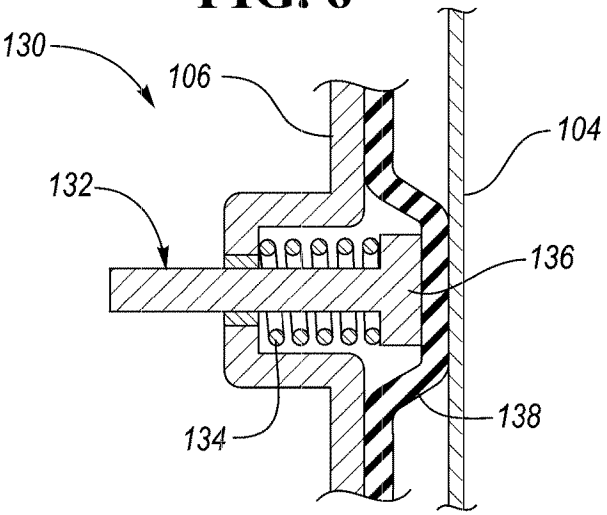
FIG. 7 is a cross-sectional view taken along line 6-6 in FIG. 5 illustrating the plunger mechanism when the door is in the closed and locked position.
Figure 5:
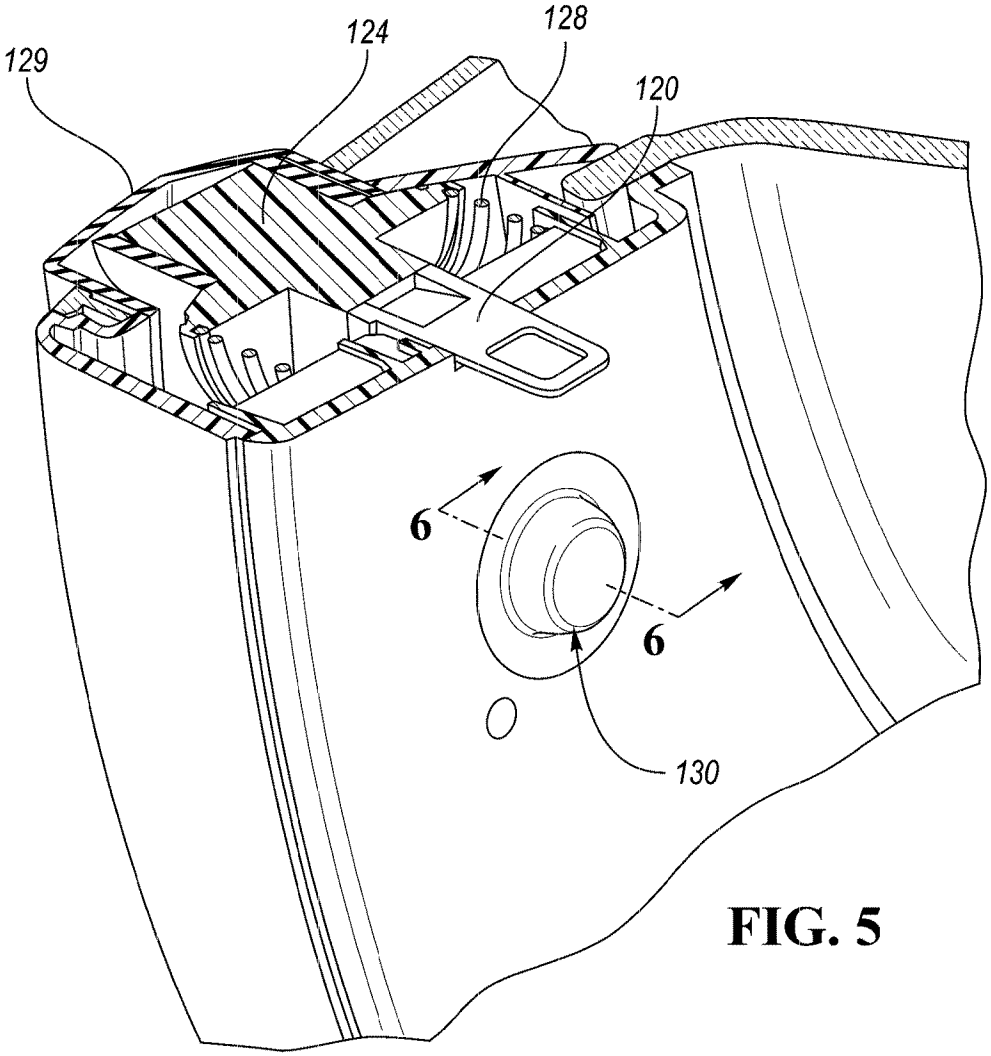
FIG. 5 is a cross-sectional view of the door illustrating an interior side of the door.

Referring now to FIGS. 5-7, a plunger system 130 that is configured to secure the door 106 in the closed and unlocked position (e.g., FIG. 3) is illustrated. The plunger system includes a plunger 132 the extends from the door 106. A biasing element 134 engages and/or is secured to the door 106 and is configured to bias the plunger 132 away from the door 106 and toward the front panel 104. Upon engagement between the plunger 132 and the front panel 104, the biasing element 134 is also configured to bias the door 106 away from the front panel 104 when the door 106 is in the closed position and the striker 120 is disengaged from the latch 116 to facilitate forming the gap 122 between the door 106 and the front panel 104 (or more specifically to facilitate forming the gap 122 between the door 106 and the seal 118) to allow venting between the door 106 and the front panel 104. Such an engagement between the plunger 132 and the front panel 104 where the door 106 in the closed and unlocked position is illustrated in FIG. 6.

Upon engagement between the plunger 132 and the front panel 104, the biasing element 134 is further compressed when the door 106 is in the closed and locked position (i.e., while the striker 120 is engaging the latch 116) relative to when the door 106 is in the closed and unlocked position. Such an engagement between the plunger 132 and the front panel 104, where the door 106 is in the closed and locked position, is illustrated in FIG. 7. Such further compression of the biasing element 134 results in the plunger 132 translating the force generated by the biasing element 134 to the front panel 104. The force applied by the plunger 132 to the front panel 104 facilitates a transition back to the closed and unlocked position from the closed and locked position as soon as the striker 120 is disengaged from the latch 116.

The plunger 132 may include a magnet 136 disposed along an end of the plunger 132. The magnet may engage and/or may be secured to an end of the biasing element 134. The magnet 136 is configured to engage the front panel 104 to retain the door 106 in the closed and unlocked position (i.e., while the striker 120 is disengaged from the latch 116). The magnet 136 may also be configured to engage the front panel 104 when the door 106 is in the closed and locked position (i.e., while the striker 120 is engaging the latch 116) to translate the force generated by the compressed biasing element 134 to the front panel 104. A flexible membrane or boot 138 made from a soft material, such as rubber or soft plastic, may be disposed about the magnet 136 and between the magnet 136 and the front panel 104. The boot 138 may be configured to prevent the magnet from scratching the surface finish of the front panel 104.

In an alternative embodiment, the plunger system 130 may extend from the front panel 104 and engage the door 106 as opposed to extending from the door 106 and engaging the front panel 104. Such a configuration may be illustrated by simply switching the call out numbers 104 and 106 in FIGS. 6 and 7.

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A front-loading washing machine comprising;

a door frame;

a latch secured to the door frame;

a door secured to the door frame and configured to transition between (i) an open position, (ii) a closed and locked position, and (iii) a closed and unlocked position;

a striker secured to the door and configured to engage the latch to lock the door in the closed and locked position;

a seal disposed on the door frame and configured to engage the door to prevent fluid transport between the door and the door frame when the door is in the closed and locked position and the striker is engaging the latch;

a plunger slidably secured to the door, spaced-apart from the striker, and configured to engage the door frame to maintain the door in the closed and unlocked position;

a biasing element (i) disposed between the door and the plunger, (ii) configured to bias the door away from the door frame when (a) the door is in the closed and unlocked position, (b) the plunger is engaging the door frame, and (c) the striker is disengaged from the latch such that a gap is formed between the seal and the door to facilitate venting between the door and the door frame, and (iii) configured to compress in response to the door being in the closed and locked position; and a flexible membrane secured to the door, over the plunger, and over the biasing element such that (i) the plunger and the biasing element are disposed between the door and the membrane and (ii) the plunger is configured to engage the door frame through the membrane to maintain the door in the closed and unlocked position.

2. The washing machine of claim 1 further comprising a push button, and wherein (i) the striker is secured to the push button, (ii) the striker and push button are collectively slidable relative to the door, and (iii) engagement of the push button when the door is in the closed and unlocked position (a) collectively slides the push button and the striker relative to the door and (b) advances the striker toward the latch such the striker engages the latch to lock the door in the closed and locked position.

3. The washing machine of claim 2 further comprising a second biasing element (i) engaging the push button and the door and (ii) configured to bias (a) the push button away from the door and (b) the striker toward disengagement from the latch.

4. The washing machine of claim 3, wherein the second biasing element is further configured to bias the push button away from the latch.

5. The washing machine of claim 1 further comprising a magnet (i) secured to an end of the plunger and (ii) disposed between the door and the membrane, wherein the magnet is configured to engage the door frame to retain the door in the closed and unlocked position while the striker is disengaged from the latch.

6. The washing machine of claim 1, wherein the striker defines an orifice, and wherein the latch is configured to extend through the orifice to lock the door in the closed and locked position.

7. A front-loading washing machine comprising:

a door frame;

a latch secured to the door frame;

a door secured to the door frame and configured to transition between (i) an open position, (ii) a closed and locked position, and (iii) a closed and unlocked position;

a seal disposed between the door and the door frame, wherein the seal is configured to prevent fluid transport between the door and the door frame when the door is in the closed and locked position;

a striker secured to the door and configured to (i) disengage the latch in a first position while the door is in the closed and unlocked position such that a gap is formed between the seal and the door to facilitate venting between an interior and an exterior of the washing machine, and (ii) engage the latch in a second position while the door is in the closed and locked position such that the seal engages the door to inhibit venting between the interior and the exterior of the washing machine;

a plunger slidably secured to the door, spaced-apart from the striker, and configured to engage the door frame to maintain the door in the closed and unlocked position; and a flexible membrane secured to the door and over the plunger such that (i) the plunger is disposed between the door and the membrane and (ii) the plunger is configured to engage the door frame through the membrane to maintain the door in the closed and unlocked position.

8. The washing machine of claim 7 further comprising a push button, and wherein (i) the striker is secured to the push button (ii) the striker and push button are collectively slidable relative to the door, and (iii) engagement of the push button when the door is in the closed and unlocked position (a) collectively slides the push button and the striker relative to the door and (b) advances the striker from the first position toward the second position such the striker engages the latch to lock the door in the closed and locked position.

9. The washing machine of claim 8 further comprising a biasing element (i) engaging the push button and the door and (ii) configured to bias (a) the push button away from the door and (b) the striker toward disengagement from the latch.

10. The washing machine of claim 9, wherein the biasing element is further configured to bias the push button away from the latch.

11. The washing machine of claim 7 further comprising a biasing element (i) disposed between the door and the plunger, (ii) configured to bias the door away from the door frame when (a) the door is in the closed and unlocked position, (b) the plunger is engaging the door frame, and (c) the striker is disengaged from the latch such that the gap is formed between the seal and the door or the door frame, and (iii) configured to compress in response to the door being in the closed and locked position.

12. The washing machine of claim 11 further comprising a magnet (i) secured to an end of the plunger and (ii) disposed between the door and the membrane, wherein the magnet is configured to engage the door frame to retain the door in the closed and unlocked position while the striker is disengaged from the latch.

13. The washing machine of claim 7, wherein the striker defines an orifice, and wherein the latch is configured to extend through the orifice to lock the door in the closed and locked position.

14. A front-loading washing machine comprising;

a door frame;

a latch secured to the door frame;

a door rotatably secured to the door frame and configured to transition between (i) an open position, (ii) a closed and locked position, and (iii) a closed and unlocked position;

a seal disposed between door and the door frame;

a striker secured to the door and configured to (i) disengage the latch in a first configuration while the door is in a closed and unlocked position such that a gap is formed between the door and the door frame to facilitate venting from an interior of the washing machine, and (ii) engage the latch in a second configuration while the door is in the closed and locked position such that the seal closes the gap between the door and the door frame to inhibit venting from the interior of the washing machine;

a plunger slidably secured to the door, spaced-apart from the striker, and configured to engage the door frame to maintain the door in the closed and unlocked position; and a flexible membrane secured to the door and over the plunger such that (i) the plunger is disposed between the door and the membrane and (ii) the plunger is configured to engage the door frame through the membrane to maintain the door in the closed and unlocked position.

15. The washing machine of claim 14 further comprising a push button, and wherein (i) the striker is secured to the push button, (ii) the striker and push button are collectively slidable relative to the door, and (iii) engagement of the push button when the door is in the closed and unlocked position (a) collectively slides the push button and the striker relative to the door and (b) advances the striker such the striker engages the latch to lock the door in the closed and locked position.

16. The washing machine of claim 15 further comprising a biasing element (i) engaging the push button and the door and (ii) configured to bias (a) the push button away from the door and (b) the striker toward disengagement from the latch.

17. The washing machine of claim 16, wherein the biasing element is further configured to bias the striker toward disengagement from the latch.

18. The washing machine of claim 14 further comprising a biasing element (i) disposed between the door and the plunger, (ii) configured to bias the door away from the door frame when (a) the door is in the closed and unlocked position, (b) the plunger is engaging the door frame, and (c) the striker is disengaged from the latch such that the gap is formed between the seal and the door or the door frame, and (iii) configured to compress in response to the door being in the closed and locked position.

19. The washing machine of claim 18 further comprising a magnet (i) secured to an end of the plunger and (ii) disposed between the door and the membrane, wherein the magnet is configured to engage the door frame to retain the door in the closed and unlocked position while the striker is disengaged from the latch.

20. The washing machine of claim 14, wherein the striker defines an orifice, and wherein the latch is configured to extend through the orifice to lock the door in the closed and locked position.

* * * * *